US006024016A

United States Patent [19]

Shimohatsubo et al.

[11] Patent Number: 6,024,016

[45] Date of Patent: Feb. 15, 2000

[54] FLEXOGRAPHIC INK FEEDING APPARATUS

[75] Inventors: Makoto Shimohatsubo; Kunio Niuchi, both of Mihara, Japan

[73] Assignee: Mitsubishi Heavy Industries, Ltd., Tokyo, Japan

[21] Appl. No.: 09/266,545

[22] Filed: Mar. 11, 1999

[30] Foreign Application Priority Data

Mar. 11, 1998 [JP] Japan ..... 10-059360

[51] Int. Cl.[7] ..... B41F 31/00

[52] U.S. Cl. ..... 101/350.6; 101/350.5; 101/364

[58] Field of Search ..... 101/160–162, 101/167, 202, 205–208, 210, 305, 309, 310, 314, 315, 320, 321, 324, 326, 329–331, 348, 349.1, 350.1, 350.5, 350.6, 363, 364

[56] References Cited

U.S. PATENT DOCUMENTS

| | | | |
|---|---|---|---|
| 3,641,932 | 2/1972 | Behringer | 101/366 |
| 5,243,907 | 9/1993 | Weishew | 101/364 |
| 5,327,830 | 7/1994 | Gelinas et al. | 101/363 |
| 5,406,887 | 4/1995 | Hertel et al. | 101/366 |
| 5,481,974 | 1/1996 | Sarazen et al. | 101/363 |
| 5,671,673 | 9/1997 | Boose et al. | 101/363 |

FOREIGN PATENT DOCUMENTS

| | | |
|---|---|---|
| 94 05 883 | 6/1994 | Germany . |
| 297 18 387 U | 1/1998 | Germany . |
| WO93 24328 | 12/1993 | WIPO . |

OTHER PUBLICATIONS

European Search Report for EP 99 30 1790 completed Jul. 5, 1999 by J. Loncke.

*Primary Examiner*—Kimberly L. Asher
*Attorney, Agent, or Firm*—Alston & Bird LLP

[57] ABSTRACT

There is provided a flexographic ink feeding apparatus in which a part of a chamber into which ink is fed is defined by a blade mounting plate and blades, characterized in that a junction of the blade mounting plate and the blade is formed so as to make an obtuse angle.

6 Claims, 5 Drawing Sheets

FLEXOGRAPHIC INK FEEDING APPARATUS

BACKGROUND OF THE INVENTION AND RELATED ART STATEMENT

1. Field of the Invention

The present invention relates to an ink feeding apparatus in a flexographic press.

2. Description of Related Art

FIG. 7 schematically shows a conventional chamber doctor blade type ink feeding apparatus (hereinafter referred to simply as "ink feeding apparatus") in a flexographic press. In this ink feeding apparatus, a beam 2 is disposed so as to face the surface of an anilox roll 1. This beam 2 has a width approximately equal to the total length of the anilox roll 1. The beam 2 is provided with a blade mounting plate 3. The upper part of the blade mounting plate 3 is formed with an inclined face 3*a* extending rearward obliquely, and the lower part thereof is also formed with an inclined face 3*b* extending rearward obliquely. On the inclined faces 3*a* and 3*b*, a seal blade 4 and a doctor blade 5 are disposed, respectively. The tip ends of the seal blade 4 and doctor blade 5 are positioned close to or in contact with the surface of the anilox roll 1. The openings at both ends of a space defined by the blade mounting plate 3, seal blade 4, doctor blade 5, and anilox roll 1 are closed by side plates 6, 6. This space forms a chamber 7 into which ink is fed. On the other hand, a groove 2*a* is formed in the surface of the beam 2 on the side of the blade mounting plate 3, and the blade mounting plate 3 is formed with holes 3*c* which connect the groove 2*a* to the chamber 7. Further, the lower end portion of the blade mounting plate 3 is formed with a hole 3*d*, so that the chamber 7 is connected with an ink tube 8 via this hole 3*d*.

In the conventional ink feeding apparatus configured as described above, ink is fed into the chamber 7 through the ink tube 8, the ink filled in the chamber 7 is applied onto the surface of the anilox roll 1, and the ink is scraped to a predetermined film thickness by the doctor blade 5, by which the film thickness of ink is controlled.

For the above-described conventional ink feeding apparatus in a flexographic press, after the color is changed or the printing is finished, it is necessary to recover the ink in the chamber 7 and clean the chamber 7. To recover the ink and clean the chamber 7, the ink in the ink tube 8 is sucked by rotating a pump 9 in the reverse direction, cleaning water is supplied into the groove 2*a* in the beam 2, and further supplied into the chamber 7 from the groove 2*a* through the holes 3*c* to clean the interior of the chamber 7. After cleaning, the water is discharged through the ink tube 8 by using the pump 9.

However, in the above-described conventional ink feeding apparatus in a flexographic press, since the junctions of the blade mounting plate 3 and the seal blade 4 and doctor blade 5, which define the chamber 7, that is, the corners of the chamber 7 make an acute angle, the ink having accumulated in the corner portions is not recovered at the time of ink recovery. Also, even if cleaning water is circulated at the time of cleaning, it is difficult for the water to flow into the corner portions, so that thorough cleaning cannot be performed.

OBJECT AND SUMMARY OF THE INVENTION

The present invention has been made in view of the above-described situation, and accordingly an object thereof is to provide a flexographic ink feeding apparatus that is simple in construction and capable of sufficiently performing the recovery of ink in a chamber and cleaning of the interior of the chamber.

To achieve the above object, the present invention provides a flexographic ink feeding apparatus in which a part of a chamber into which ink is fed is defined by a blade mounting plate and blades, characterized in that a junction of the blade mounting plate and the blade is formed so as to make an obtuse angle.

According to the ink feeding apparatus of this invention, since there is no acute-angled portion in the chamber, there is no portion where ink enters and accumulates, so that the recovery of ink in the chamber and cleaning of the interior of the chamber can be performed easily.

In the flexographic ink feeding apparatus in accordance with the present invention, a packing member is disposed at the junction of the blade mounting plate and the blade.

According to the ink feeding apparatus of this invention, since the addition of the packing member eliminates an acute-angled portion in the chamber, the conventional parts can be used without being changed, so that an improved ink feeding apparatus can be realized at a low cost.

In the flexographic ink feeding apparatus in accordance with the present invention, the packing member is fixed to a plate, and the plate is sandwiched between the blade and the blade mounting plate, by which the packing member is held.

According to the ink feeding apparatus of this invention, the packing can be installed easily.

In the flexographic ink feeding apparatus in accordance with the present invention, the packing member is made of sponge rubber.

According to the ink feeding apparatus of this invention, since the packing member and the blade mounting plate are brought into contact with each other, ink does not enter the joining portion between them, so that the recovery of ink in the chamber and cleaning of the interior of the chamber can be performed more securely.

As described above, in the flexographic ink feeding apparatus in accordance with the present invention, since there is no acute-angled portion in the chamber, that is, there is no portion where ink enters and accumulates, ink does not accumulate at the time of ink recovery, or the flow of clean water is not disturbed at the time of cleaning. Therefore, uncleaned portions do not remain, and the recovery of ink and cleaning can be performed easily, so that the productivity can be increased. Also, when the acute-angled portion in the chamber is eliminated by the addition of the packing member, the conventional parts can be used without being changed, so that an improved ink feeding apparatus can be realized at a low cost. Further, when the packing member is fixed to a plate, and the plate is sandwiched between the blade and the blade mounting plate, by which the packing member is held, the packing can be installed easily. Also, when the packing member is made of sponge rubber, since the packing member and the blade mounting plate are brought into contact with each other, ink does not enter the joining portion between them, so that the recovery of ink and cleaning can be performed more securely.

DETAILED DESCRIPTION OF PREFERRED EMBODIMENTS

Figure 1:
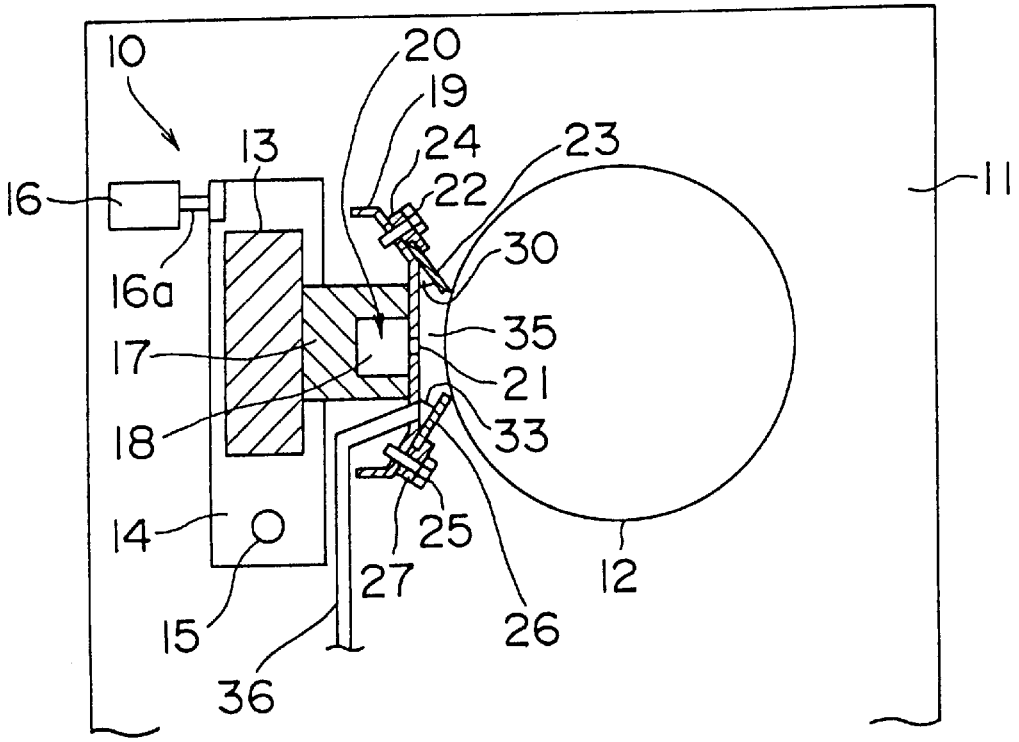
FIG. 1 is a longitudinal sectional view schematically showing a flexographic ink feeding apparatus in accordance with an embodiment of the present invention.
Figure 2:
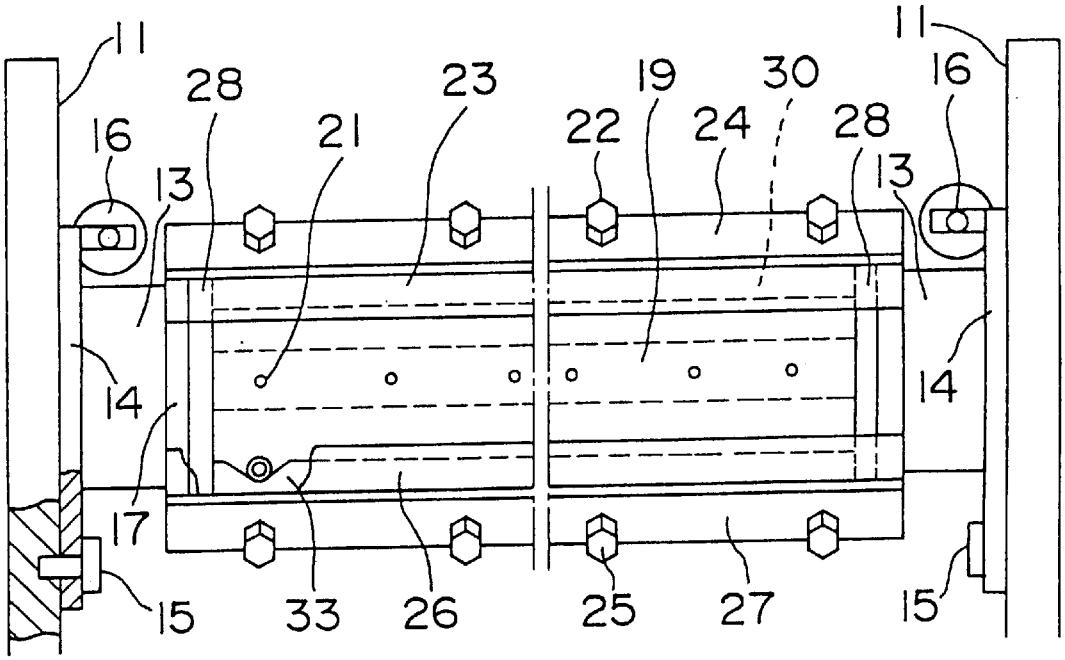
FIG. 2 is a front view schematically showing the ink feeding apparatus of FIG. 1 wherein the anilox roll 12 of FIG. 1 has been removed to illustrate the ink chamber, and further wherein a portion of the doctor blade is cut away to reveal an ink tube disposed at the bottom of a notch in a packing member positioned in the ink chamber in a flexographic ink feeding apparatus in accordance with an embodiment of the present invention.

The present invention will be described in detail with reference to an embodiment shown in the drawings. FIG. 1 is a longitudinal sectional view schematically showing a flexographic ink feeding apparatus in accordance with an embodiment of the present invention, and FIG. 2 is a front view schematically showing an ink feeding apparatus excluding an anilox roll.

In this ink feeding apparatus 10, an anilox roll 12 is disposed between press frames 11, 11, and is supported on them so as to be rotatable. In parallel with the axis of the anilox roll 12, a beam 13 having a rectangular cross section is arranged, and side plates 14, 14 are fixed to the both ends of the beam 13. The lower part of the side plate 14 is rotatably supported on the frame 11 with a pin 15. Also, an air cylinder 16 is disposed on the frame 11, and a piston rod 16*a* of the air cylinder 16 is connected to the upper part of the side plate 14.

Figure 3:
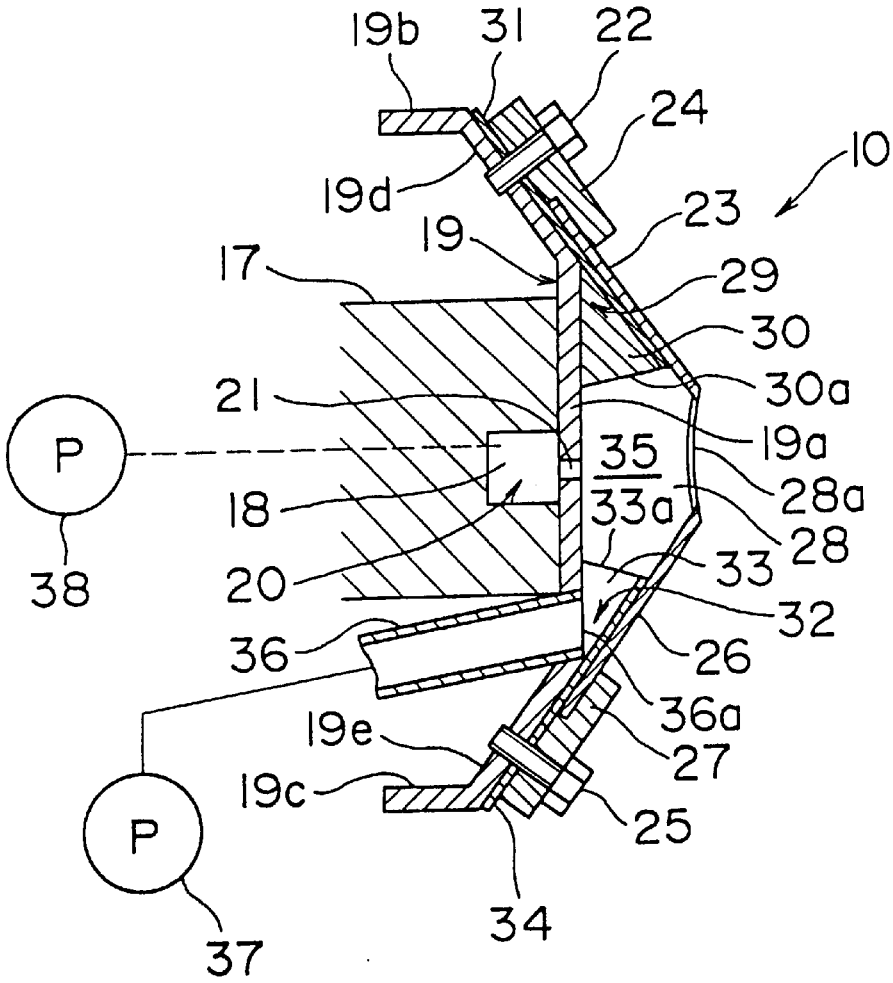
FIG. 3 is a longitudinal sectional view enlargedly showing a principal portion of the ink feeding apparatus shown in FIG. 1.

On the surface of the beam 13 on the side of the anilox roll 12 is disposed a block 17 having a length substantially corresponding to the total length of the anilox roll 12. A groove 18 is formed in the surface of the block 17 on the side of the anilox roll 12 over the substantially the total length of the block 17, and a blade mounting plate 19 is fixed onto the surface of the block 17 on the side of the anilox roll 12 so as to cover the groove 18. A conduit 20 is formed by the groove 18 and the blade mounting plate 19, and communicates with a chamber, described later, via holes 21 formed in the blade mounting plate 19. As shown enlargedly in FIG. 3, the blade mounting plate 19 has a vertical wall 19*a* which covers the groove 18, horizontal walls 19*b* and 19*c* disposed so as to cover the upper and lower parts of the block 17, respectively, and inclined walls 19*d* and 19*e* formed obliquely at the boundary of the horizontal walls 19*b* and 19*c*. A base end portion of a seal blade 23 is fastened to the inclined wall 19*d* via a press plate 24 with bolts 22, and the tip end of the seal blade 23 is positioned close to the surface of the anilox roll 12 (see FIG. 1). Also, a base end portion of a doctor blade 26 is fastened to the inclined wall 19*e* via a press plate 27 with bolts 25, and the tip end of the doctor blade 26 is positioned close to the surface of the anilox roll 12 (see FIG. 1).

Also, end plates 28, 28 are disposed at both side ends of the blade mounting plate 19 to close side openings defined by the blade mounting plate 19, seal blade 23, and doctor blade 26. The end plate 28 has a seal member 28*a* bonded on the side of the anilox roll 12, which seals a gap between the end plate 28 and the anilox roll 12.

Further, a packing member 30, made of sponge rubber, is disposed in an acute-angled corner portion 29 defined by the seal blade 23 and the vertical wall 19*a* of the blade mounting plate 19, and a plastic mounting plate 31 is bonded to the packing member 30. The packing member 30 is arranged in a space by fastening the mounting plate 31 between the seal blade 23 and the inclined wall 19*d* of blade mounting plate 19. The packing member 30 serves to eliminate the effect of the acute angle of the corner portion 29. By a free end face 30*a* of the packing member 30, a junction of the free end face 30*a* and the vertical wall 19*a* of the blade mounting plate 19 and a junction of the free end face 30*a* and the seal blade 24 are formed so as to make an obtuse angle.

Also, a packing member 33, made of sponge rubber, is disposed in an acute-angled corner portion 32 defined by the doctor blade 26 and the vertical wall 19*a* of the blade mounting plate 19, and a plastic mounting plate 34 is bonded to the packing member 33. The packing member 33 is arranged in a space by fastening the mounting plate 34 between the doctor blade 26 and the inclined wall 19*e* of blade mounting plate 19. The packing member 33 serves to eliminate the effect of the acute angle of the corner portion 32. By a free end face 33*a* of the packing member 33, a junction of the free end face 33*a* and the vertical wall 19*a* of the blade mounting plate 19 and a junction of the free end face 33*a* and the doctor blade 26 are formed so as to make an obtuse angle.

Figure 4:
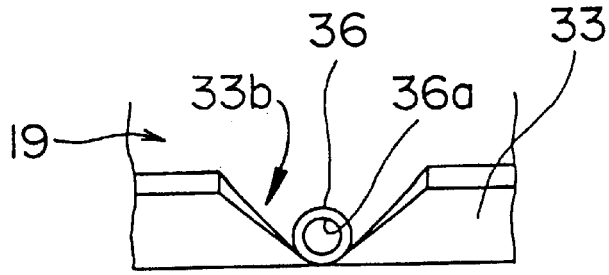
FIG. 4 is a front view showing a construction in which a tip end of an ink tube is attached.

A chamber 35 into which ink is fed is defined by the blade mounting plate 19, seal blade 23, doctor blade 26, packing members 30 and 33, end plates 28, 28, and the anilox roll 12. At the lower part of the blade mounting plate 19 defining this chamber 35, one end of an ink tube 36 is inserted and fixed. In order to position a tip end opening 36*a* of the ink tube 36 at the lowermost portion of the chamber 35, a notch 33*b* is formed in the upper surface of the packing member 33, and the tip end opening 36*a* of the ink tube 36 is disposed at the bottom of the notch 33*b* as shown in FIG. 4.

In the ink feeding apparatus 10 thus configured, ink is fed into the chamber 35 via the ink tube 36 by using a pump 37. This ink is applied to the surface of the rotating anilox roll 12, and the thickness of the applied ink is controlled to a predetermined value by the doctor blade 26. Also, in this ink feeding apparatus 10, at the time of ink change or cleaning of the interior of the chamber 35, the ink in the chamber 35 is discharged by rotating the pump 37 in the reverse direction, and clean water is supplied into the chamber 35 through the conduit 20 and the holes 21 in the blade mounting plate 19 by driving a pump 38. Thereby, the cleaning water circulates through the chamber 35 to clean the interior thereof. After cleaning, the cleaning water is discharged to the outside through the ink tube 36 by using the pump 37.

Figure 5:
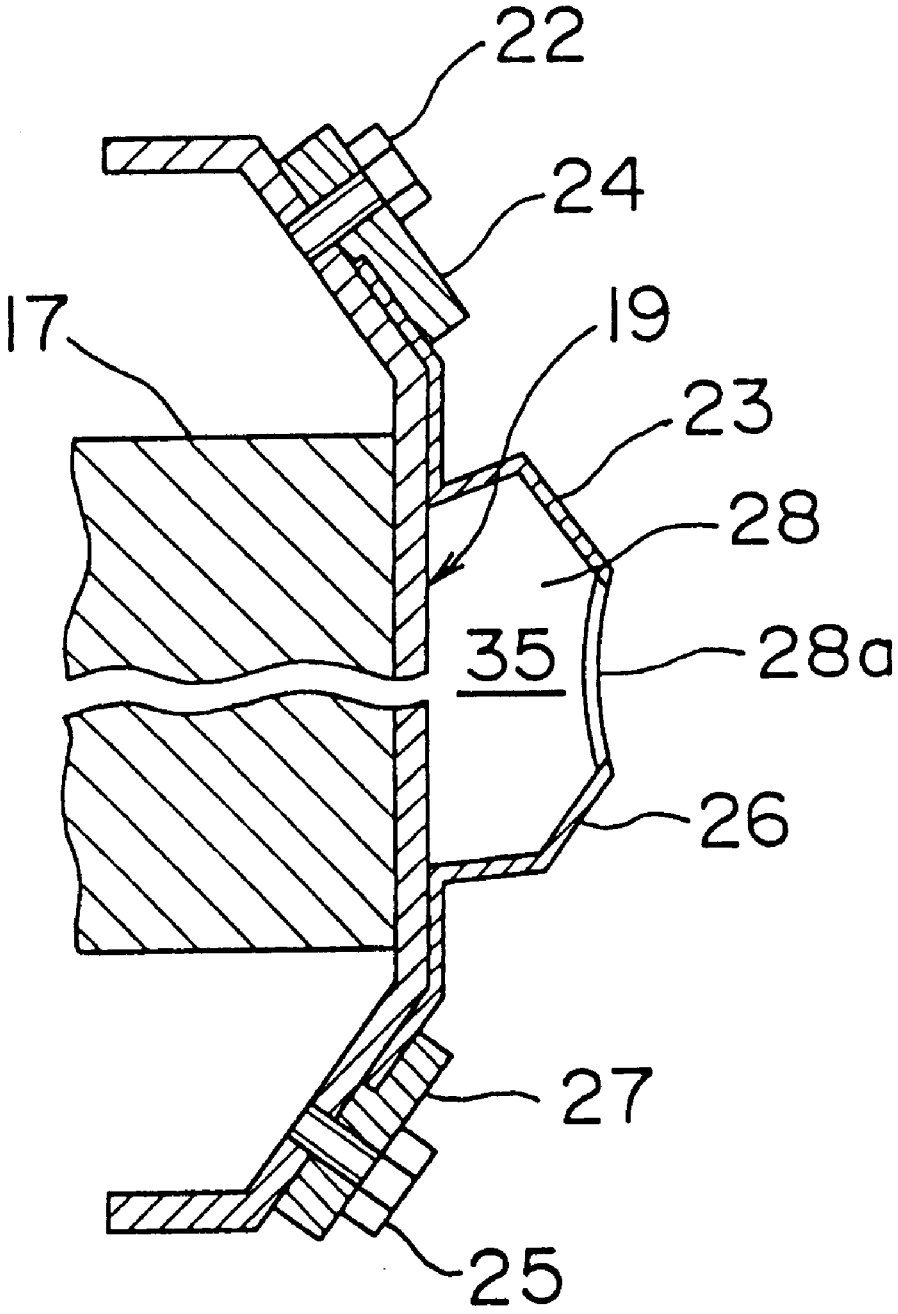
FIG. 5 is a schematic longitudinal sectional view enlargedly showing a principal portion of a modification of a flexographic ink feeding apparatus in accordance with an embodiment of the present invention.
Figure 6:
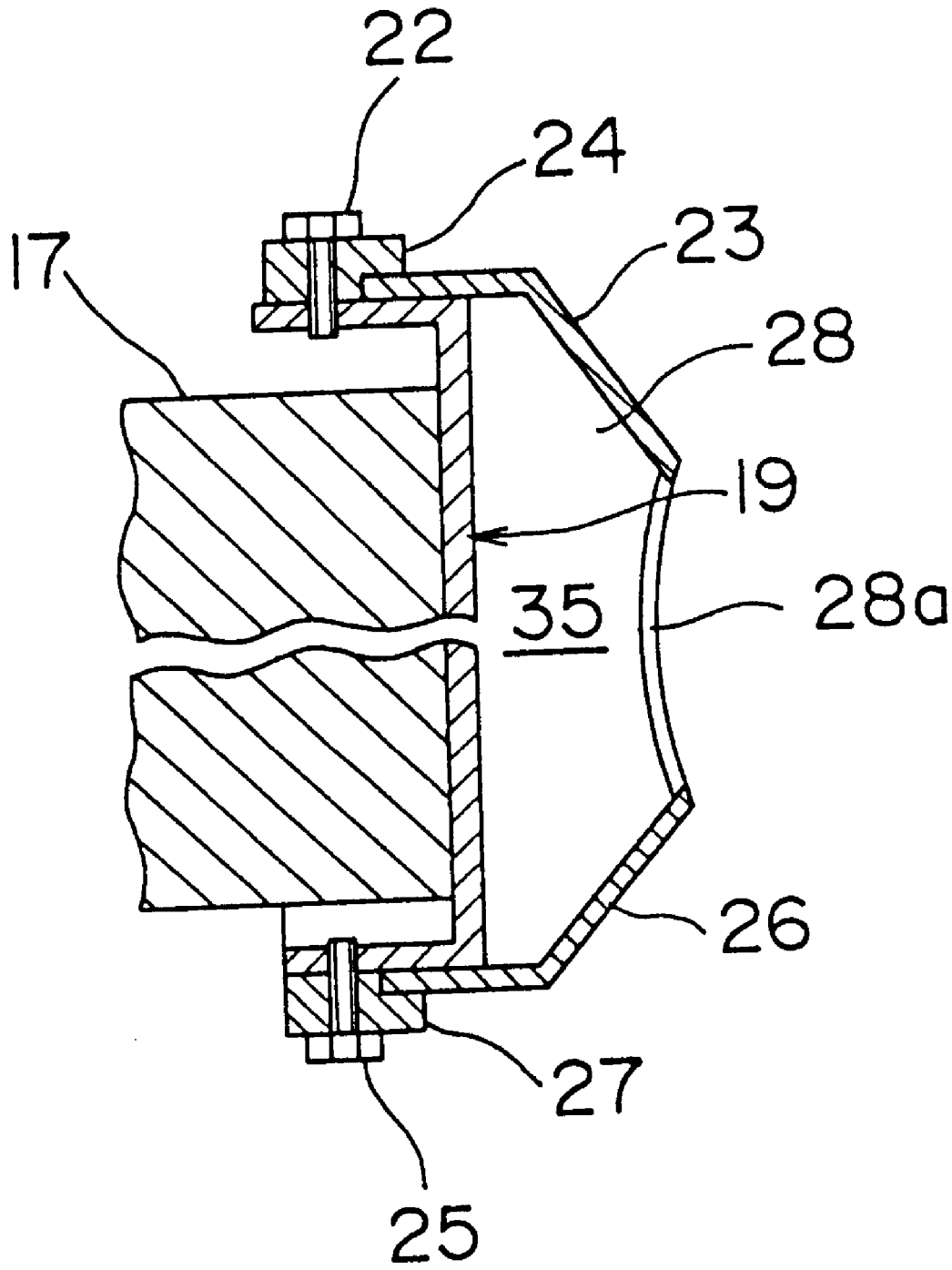
FIG. 6 is a schematic longitudinal sectional view enlargedly showing a principal portion of another modification of a flexographic ink feeding apparatus in accordance with an embodiment of the present invention.
Figure 7:
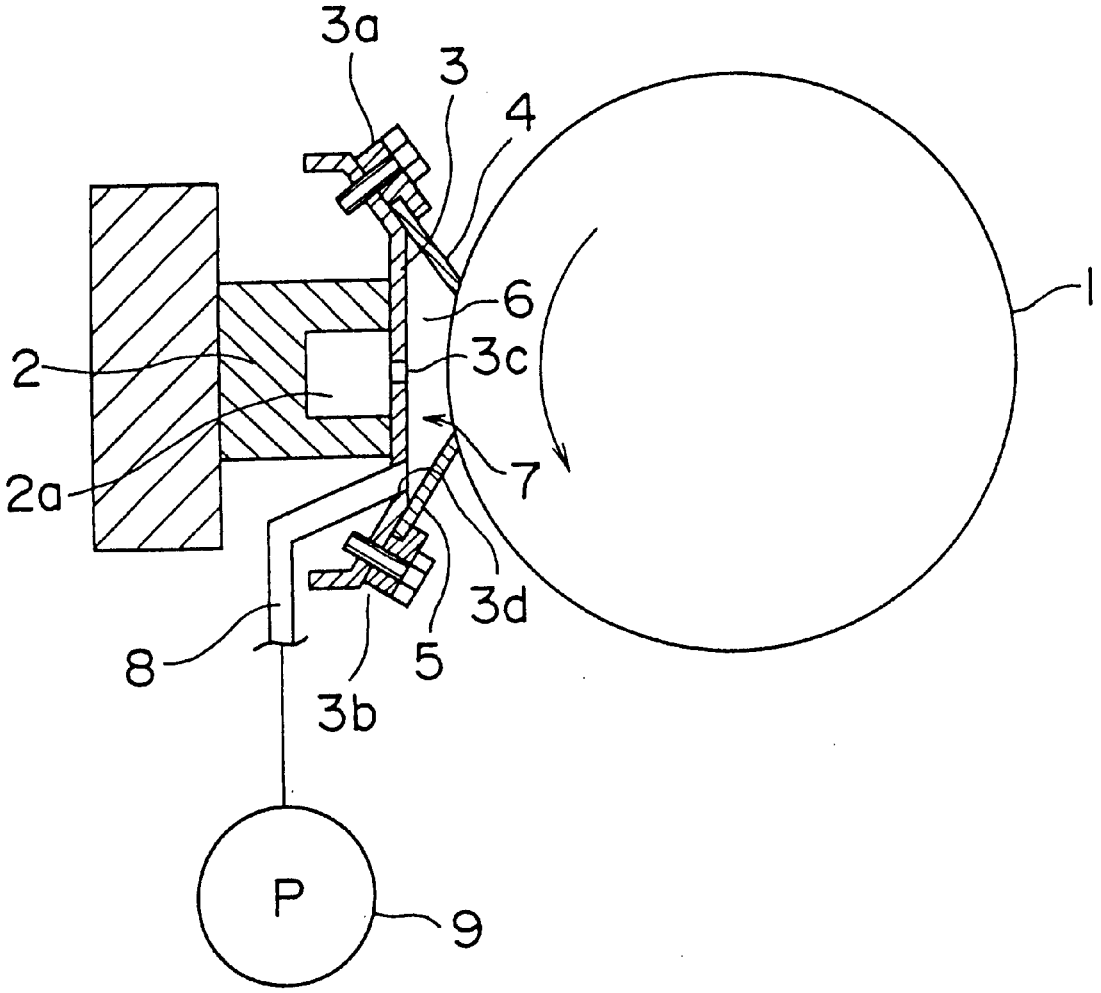
FIG. 7 (PRIOR ART)
FIG. 7 is a longitudinal sectional view schematically showing a conventional flexographic ink feeding apparatus.

Although the acute-angled portions of the chamber 35 are eliminated by disposing the packing members 30 and 33 in the corner portions 29 and 32 defined by the blade mounting plate 19 and the seal blade 23 and doctor blade 26, respectively, in the above embodiment, the acute-angled portion of the chamber 35 can be eliminated, for example, by bending the seal blade 23 and the doctor blade 26 as shown in FIGS. 5 and 6.

We claim:

1. A flexographic ink feeding apparatus, comprising:

a blade mounting plate;

at least one blade having a portion thereof mounted to, and a portion thereof extending away from said blade mounting plate; and an ink chamber defined in part by a first wall formed by a portion of said blade mounting plate and by a second wall formed by at least a portion of said portion of said blade extending away from said blade mounting plate, and by a third wall engaging said first wall and said second wall and extending therebetween, said third wall forming an obtuse angle with said first wall.

2. A flexographic ink feeding apparatus according to claim 1, wherein said portion of said blade extending away from said blade mounting plate forms a junction with said blade mounting plate and wherein said third wall is defined by a packing member disposed at the junction of said blade mounting plate and said blade.

3. A flexographic ink feeding apparatus according to claim 2, wherein said packing member is fixed to a plate, and said plate is sandwiched between said blade and said blade mounting plate.

4. A flexographic ink feeding apparatus according to claim 3, wherein said packing member is made of sponge rubber.

5. A flexographic ink feeding apparatus according to claim 2, wherein said packing member is made of sponge rubber.

6. A flexographic ink feeding apparatus according to claim 1, wherein said third wall is defined by a second portion of said portion of said blade extending away from said blade mounting plate.

* * * * *